US005560390A

United States Patent [19]

Royds

[11] Patent Number: 5,560,390

[45] Date of Patent: Oct. 1, 1996

[54] PORTABLE HOSE REEL FOR RECREATIONAL VEHICLES

[76] Inventor: Jerry L. Royds, 123 Mapleburn Dr. SE., Calgary, Alberta, Canada, T2J 1Y3

[21] Appl. No.: 302,364

[22] Filed: Sep. 7, 1994

[51] Int. Cl.[6] ..... B65H 75/34

[52] U.S. Cl. ..... 137/355.12; 137/355.26

[58] Field of Search ..... 137/355.12, 355.26, 137/355.27

[56] References Cited

U.S. PATENT DOCUMENTS

| | | | |
|---|---|---|---|
| 2,519,064 | 8/1950 | Palm | 137/355.19 |
| 2,696,406 | 12/1954 | Meyers | 137/355.2 |
| 3,388,716 | 6/1968 | Wilson | 137/355.22 |
| 3,433,247 | 3/1969 | Haselden | 137/355.26 |
| 4,131,381 | 12/1978 | Alberta | 403/353 |
| 4,224,960 | 9/1980 | Nederman | 137/355.23 |
| 4,506,698 | 3/1985 | Garcia et al. | 137/355.26 |
| 4,512,361 | 4/1985 | Tisbo et al. | 137/355.27 |
| 4,660,803 | 4/1987 | Johnston et al. | 251/149.1 |

*Primary Examiner*—A. Michael Chambers

[57] ABSTRACT

A portable water hose connection, storage and transport device for recreational vehicles. This device includes a rotatably mounted reel for windably accepting potable water hose. The reel is comprised of a hub, threaded inlet elbow and reel sides all formed unitarily and mounted over a cantilever spigot shaft. The spigot shaft has a flow through capacity and threaded apertures at each end to accept female connectors which act as water outlet ports when connected to mateable male connectors. The spigot shaft contains water inlet ports on a centrally located fluted circumference between inner body o-ring seals. This creates a flow through passage from the reel inlet elbow to the female connectors. A portable mounting bracket is formed integrally with the spigot shaft and has a pivotally connected release bar mechanism for dismounting hose reel from the recreational vehicle. Upper and lower support arms are also pivotally attached to mounting bracket with the upper support arm having a mateable coupling device for mounting on a vertical surface.

1 Claim, 6 Drawing Sheets

PORTABLE HOSE REEL FOR RECREATIONAL VEHICLES

BACKGROUND-FIELD OF INVENTION

This invention relates to a potable water supply hose connection, storage, and transport device, specifically to recreational vehicles.

BACKGROUND-DESCRIPTION OF PRIOR ART

This problem has been previously approached with the limited use of a collapsible hose which can be rolled up flat in a small cassette type reel. While these types of hoses are easy to store, they must be completely unrolled before each use. The excess hose therefore must lay on the ground.

Prior patents have addressed other aspects of this field, however only for residential use with garden hoses. U.S. Pat. No. 5,046,520 to Sanchez et al Sep. 10, 1991 or U.S. Pat. No. 4,506,698 to Garcia et al Mar. 26, 1985 are typical of the type of hose reels currently in use. The mode of connection, size and lack of portability therefore make these devices undesireable for use with recreational vehicles.

A more practical solution is needed for the following reasons:

Possible health problems due to contamination of water supply. This situation occurs when excess hose is placed on or near the sewer or waste water outlet pipe while the recreational vehicle is parked. The services provided in most campsites are placed in the same trench when constructed and the water outlet is invariably located on a post next to the sewer inlet.

A variable length of hose is needed for each new campsite and after the water connection is completed, the excess hose is left on the ground beside the recreational vehicle.

Installation of the water supply hose requires the use of both hands and excess hose is placed on the ground below. Most campsites are unimproved, so foriegn material such as dirt, grass and dead foliage collects on the hose and could enter the hose while connections are being made. This can cause the check valve to clog and cause water leakage when the self contained water pump is activated.

After use the hose is generally covered with foriegn material and is generally wet from water spills during disconnection. This makes draining and coiling the hose for storage messy and unpleasant. Very often the main task is to find a suitable clean location to re-coil the water hose for storage.

Connection and disconnection are generally inconvenient, especially when an external water supply is temporarily required outside the recreational vehicle.

OBJECTS AND ADVANTAGES

Accordingly, several objects and advantages of my recreational vehicle hose reel device are as follows:

Installation of the hose reel is considerably faster, easier and a more positive connection is made because the hose reel is connected directly to the water inlet and check valve.

The operator is allowed a measure of control as to the positioning of the hose in relation to the electrical cord and the sewer outlet pipe. Only the amount of hose required to make the connection between the water supply and the recreational vehicle need be dispensed from the reel.

The possibility of water supply contamination is lessoned because the unused portion of the supply hose remains mounted and neatly coiled in the hose reel on the side of the recreational vehicle.

This method of hose storage helps prevent the hose from becoming twisted or kinked.

Hose rewinding is very clean and easy. The hose is automatically ready for storage when hose rewinding is complete.

Hose and reel disconnection from the recreational vehicle can be accomplished without regard for water pressure remaining in the hose.

An external water supply connection is available on the hose reel. This will enable the use of an additional hose or spigot without disconnecting water supply of the recreational vehicle.

The self contained water tank of the recreational vehicle can be filled while the hose reel and main water supply is still connected to the receational vehicle.

All external mounting brackets and handles on the hose reel assembly fold flat for easy and economical storage.

Further objects and advantages of my portable hose reel will become apparent from a consideration of the drawings and the ensuing description.

DRAWING FIGURES

In the drawings, closely related components have the same number but different alphabetic suffixes.

REFERENCE NUMERALS IN DRAWINGS

10 reel mounting bracket
10-1 r.v. mount bar
10(*a*) guide rollers
10(*b*) upper pin hinge
10(*c*) lower pin hinge
10(*d*) release bar lugs
10(*e*) upper support arm
10(*f*) hinge pins
10(*g*) lower support arm
10(*h*) release bar arm
12 spigot shaft
12(*a*) reel bushing
12(*b*) rear reel bushing
12(*c*) retaining clip groove
12(*d*) annular seal grooves
12(*e*) inner body o-ring seals
12(*f*) water inlet ports
14-1 female connector (common)
14-2 female connector (common)

14(*a*) adjustment lock nut
14(*b*) washer
16(*a*) hose reel sides
16(*b*) reel connector elbow
16(*c*) reel crank lugs
16(*d*) reel hub
16(*e*) hub annular seal grooves
16(*f*) retaining clip
16(*g*) reel crank
16(*h*) hinge pin
18 male connector (common)
18(*a*) adaptor hose
18(*b*) male connector (common)
18(*c*) female connector (common)
18(*d*) external spigot
18(*e*) male connector (common)
20 hose reel cover
20(*a*) lower hinge pin
20(*b*) handle lugs
20(*c*) clasp (common)
20(*d*) hinge pins
20(*e*) handle

Description-FIGS. 1 to 6

Figure 1:
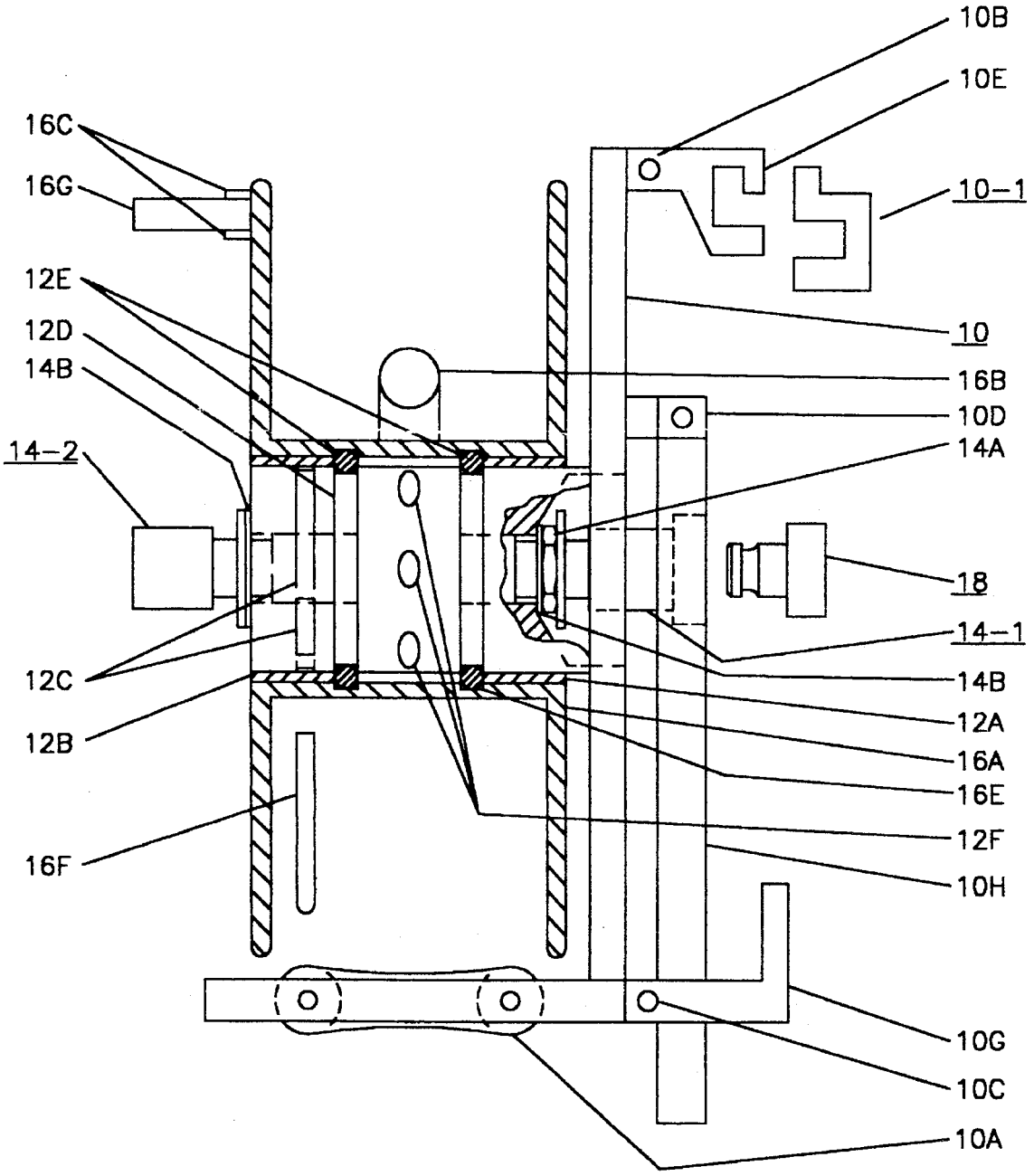
FIG. 1 Shows a side view of hose reel assembly.
Figure 2:
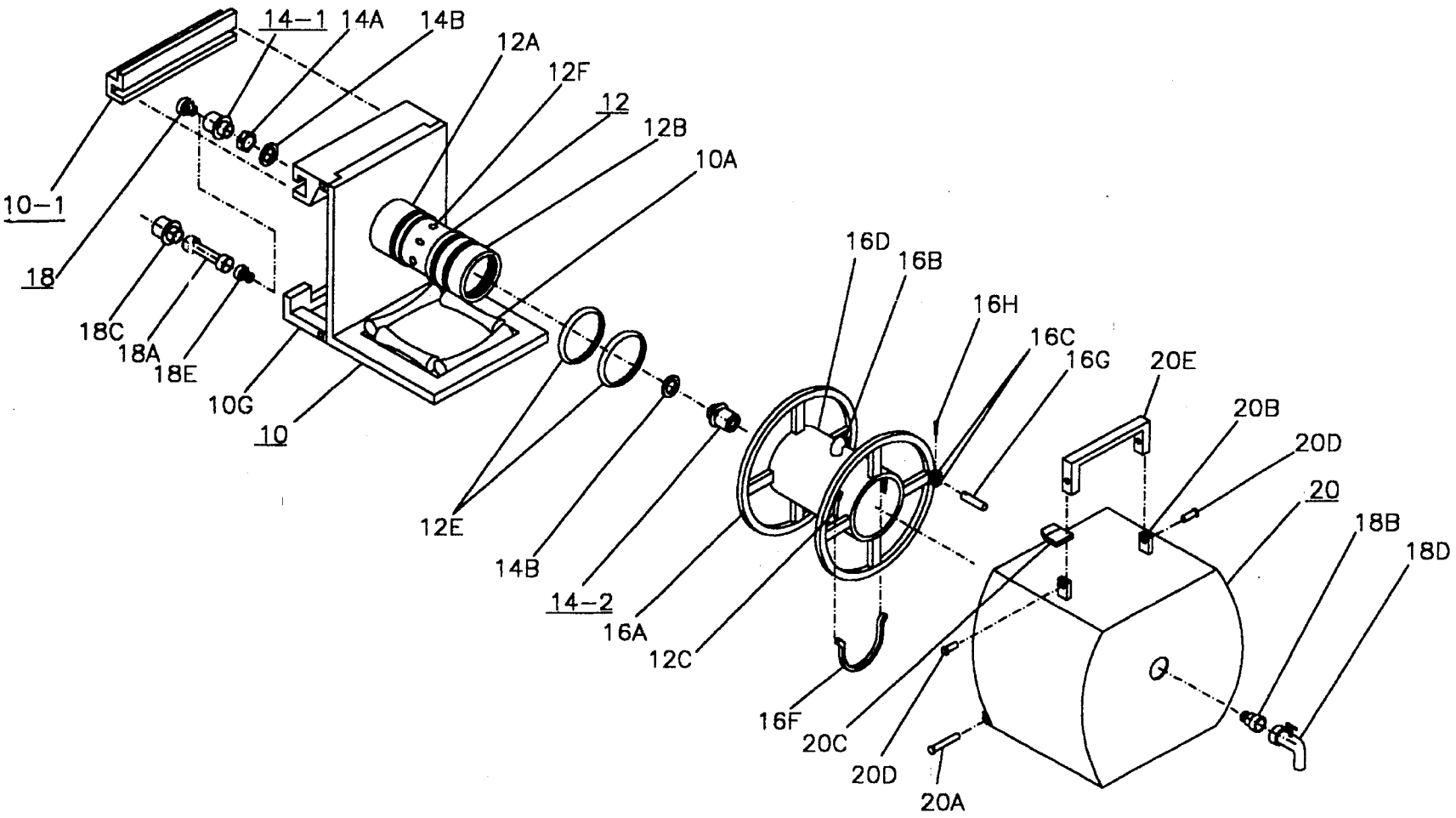
FIG. 2 Shows an isometric exploded front view of the hose reel assembly.

The preferred embodiment of the present invention is illustrated in FIG. 1 (a side view) and FIG. 2 (an isometric exploded view).

Figure 4:
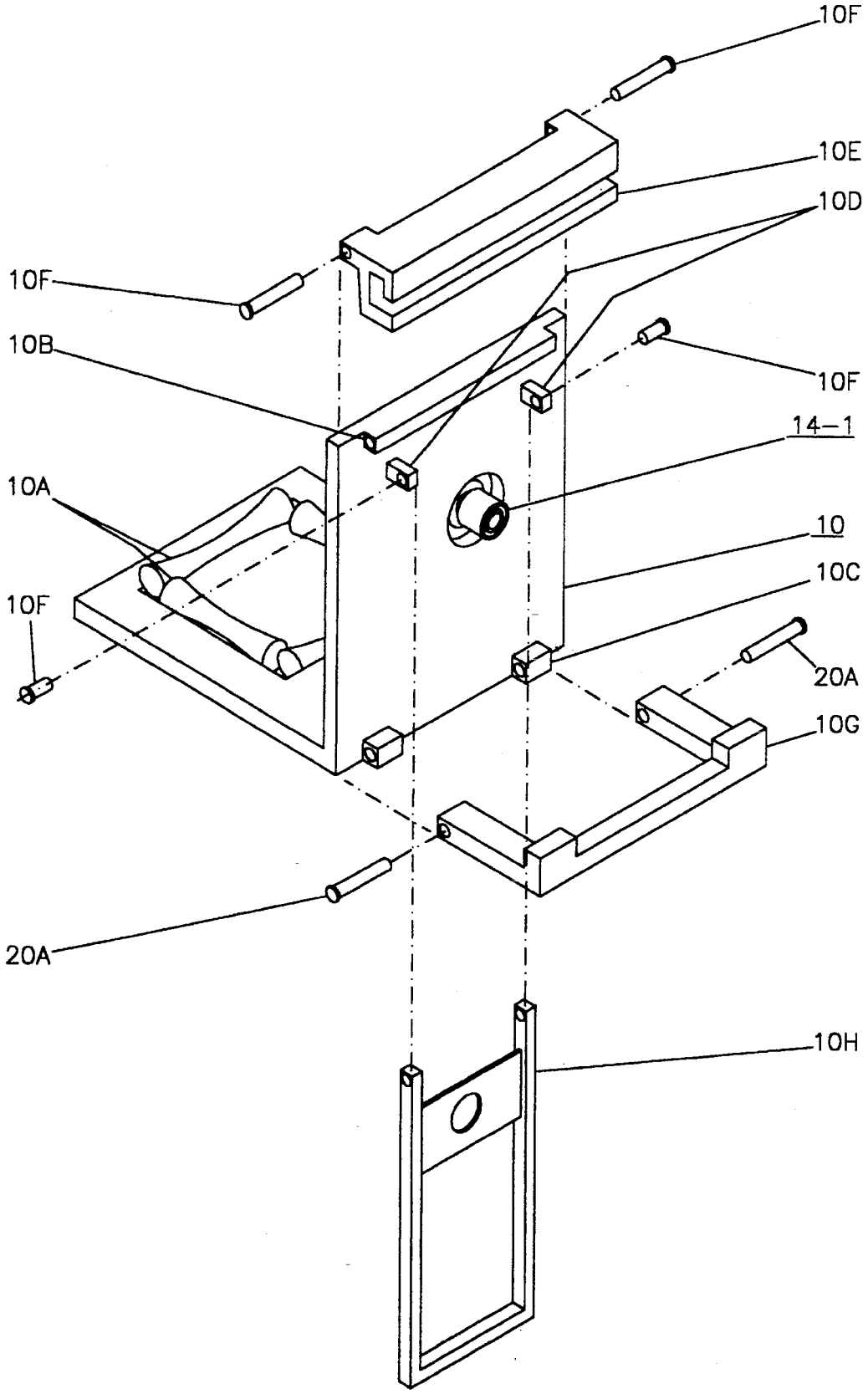
FIG. 4 Shows an isometric rear view of reel mount bracket, support arms and release bar.

The recreational vehicle hose reel consists of four main components which are as follows:

The reel mounting bracket 10 is a plastic rectangle formed with a right angle flange on the bottom end with an aperture formed therein and a plurality of guide rollers 10*a* rotably mounted in the aperture. The opposite bottom edge of mounting bracket 10 is suitably mortised and bored to form one side of a pin hinge 10*c* (FIG. 4).

The opposite top face of reel bracket 10 is suitably mortised and bored to form one side of pin hinge 10*b* and 2 release bar lugs 10*d* are formed with the body of reel mount 10. The upper support arm 10*e* is joined to the top of bracket 10 with hinge pins 10*f*, this forms the main attachment to the recreational vehicle. Lower support arm 10*g* is joined to the bottom of bracket 10 with hinge pins 20*a*. This forms a support foot for the hose reel assembly when attached to the recreational vehicle. Release bar arms 10*h* are connected to the release bar lugs 10*d* with hinge pins 10*f*. This forms the lever mechanism to detach female connector 14-1 (common) from male connector 18 (common) (FIG. 4).

Female connector 14-1 has a flow through capacity and is selectively mateable with male connector 18. An adjustment lock nut 14*a* and washer 14*b* are fitted on the threaded end of connector 14-1. Female connector 14-2 (common) has a flow through capacity and is selectively mateable with male connector 18*b* (common). A washer is fitted on the threaded end of female connector 14-2 (FIG. 2).

Spigot shaft 12 is formed integral with reel mounting bracket 10. The bracket end of spigot shaft 12 is recessed and has a threaded aperture to threadably accept female connector 14-1 and is further flaired from the edge of the recess outward. This provides clearance for operation of adjustment lock nut 14*a*. The opposite end of spigot shaft 12 is flush and has a threaded aperture to threadably accept female connector 14-2

Spigot shaft 12 is a cantilevered tube and has a flow through passage which connects to the flow through passage of female connector 14-1 and female connector 14-2 when threaded into spigot shaft 12. The exterior surface of spigot shaft 12 is comprised of two reel bushings, 12*a* and 12*b*, one at each end for the accomodation of a rotably mounted hose reel assembly. Rear reel bushing 12*b* is divided by a retaining clip groove 12*c*.

Figure 3:
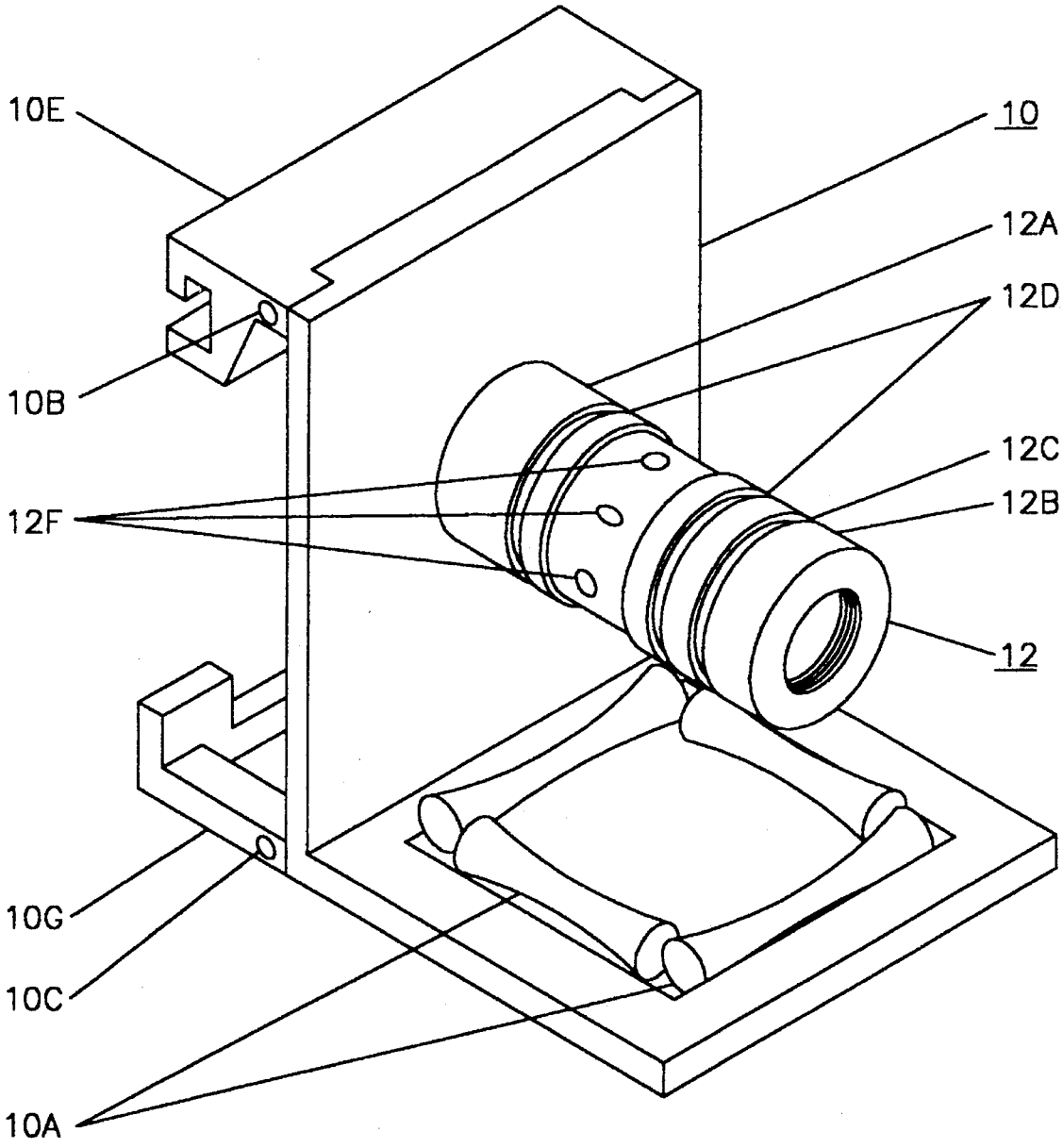
FIG. 3 Shows an isometric front view of reel mount bracket, guide rollers and spigot shaft.

Two annular seal grooves 12*d* are located on the water side and adjacent to reel bushing 12*a* and 12*b* for inner body o-ring seals 12*e*. Water inlet ports 12*f* are located on a portion of the spigot shaft 12 which is less in circumference than reel bushings 12*a* and 12*b*. This forms a part of the flow through passage. (FIG. 3).

Figure 5:
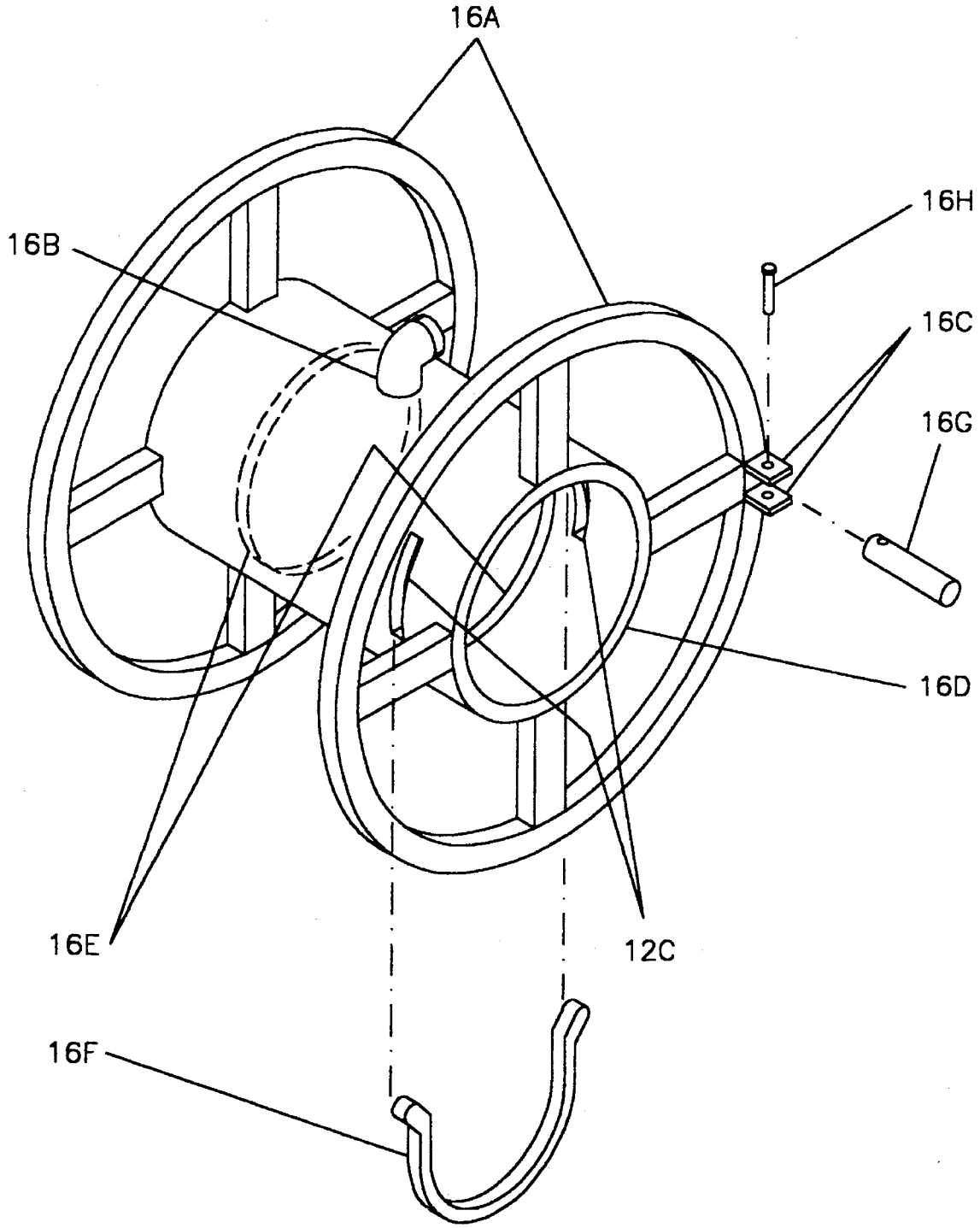
FIG. 5 Shows an isometric front view of reel assembly.

The hose reel sides 16*a*, reel connector elbow 16*b* and reel crank lugs 16*c* are formed integral with reel hub 16*d*. Reel hub 16*d* is journaled at each end to windably mount over reel bushings 12*a* and 12*b*. Two annular seal grooves 16*e* are formed adjacent to the journaled surface and align with o-ring seals 12*e* on spigot shaft 12. Two through slots are formed in reel hub 16*d* on opposite sides and in the same alignment as retaining clip groove 12*c*. This accomodates retaining clip 16*f* to prevent any lateral movement of reel hub 16*d* on spigot shaft 12. Hose reel sides 16*a* are of sufficient diameter to windably contain in 3 rows, a 13 mm potable water hose being 7.86 meters long which is threaded to reel connector elbow 16*d*. This completes the flow through passage extending therethrough. A cylindrical crank handle 16*g* is inserted between reel crank lugs 16*c* and hinge pin 16*h* is inserted through all three holes. This forms a folding reel crank handle. (FIG. 5).

Figure 6:
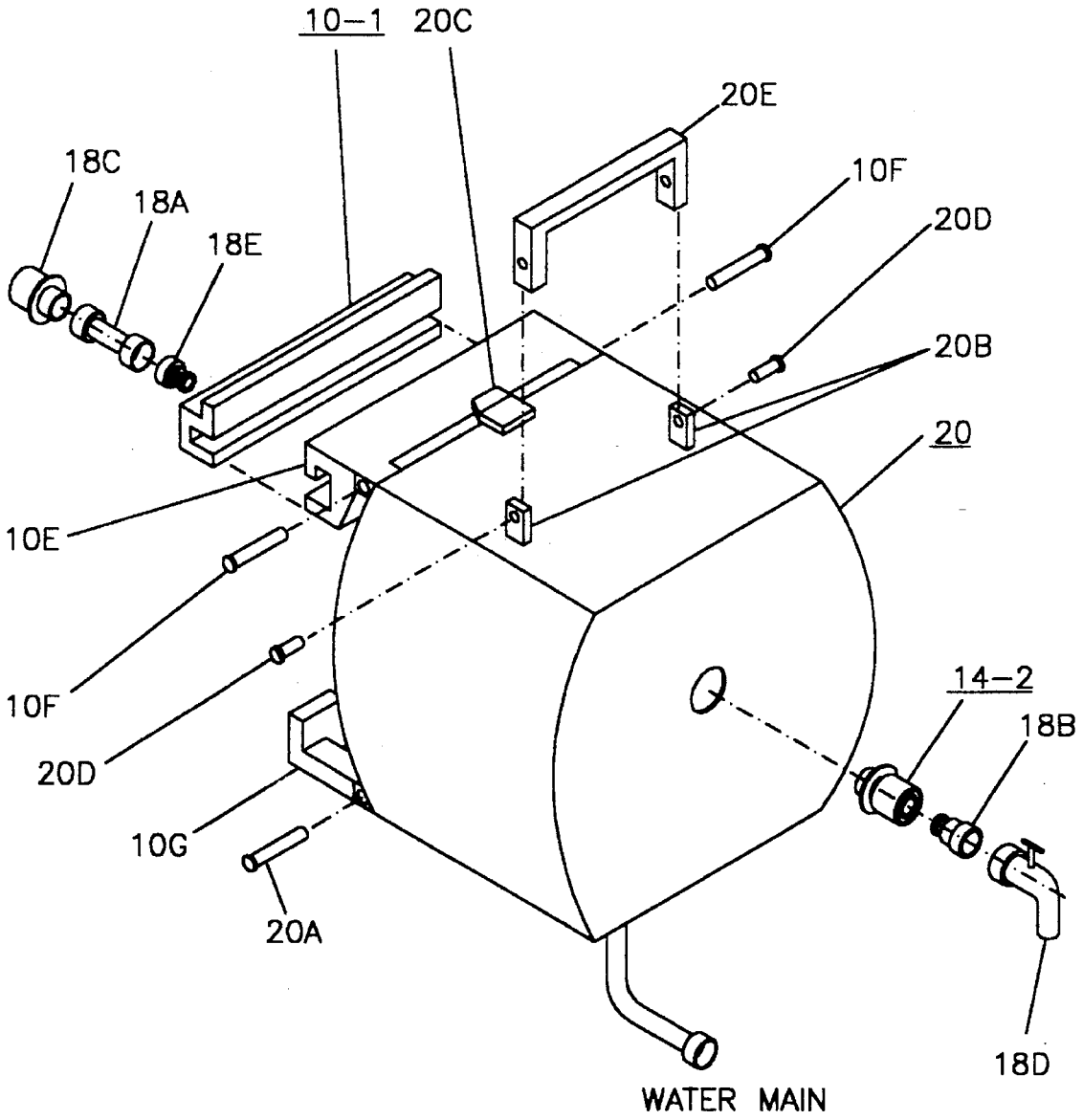
FIG. 6 shows an isometric front view of the hose reel cover r.v. mount bracket, adaptor hose and spigot.

An additional embodiment is shown in FIG. 6 (an isometric exploded front view).

Adaptor hose 18*a* is fitted with male connector 18*e* (common) and female connector 18*c* (common). Female connector 18*c* joins with male connector 18 and male connector 18*e* joins with female connector 14-1. This allows hose reel assembly to mounted in another location within the pre-determined length of the adaptor hose 18*a*.

The bottom flat side of cover 20 is cutout and one side of a pin hinge is formed suitable for interconnecting in the proper alignment with pin hinge 10*c* on reel mount bracket 10. The top flat surface is formed with handle lugs 20*b* and a clasp (common) to secure cover 20 to top of bracket 10. Hinge pins 20*d* are inserted through handle 20*e* and lugs 20*b*. This creates a folding carry handle for the entire hose reel assembly. (FIG. 6).

The face of the reel cover 20 is formed as a dome on the outer portion and convoluted to an aperture with clearance for the diameter of female connector 14-2. Height of the dome is pre-determined to facilitate its use as a storage compartment for adaptor hose 18*a*, male connector 18*e*, female connector 18*c* and an external spigot 18*d*. The hose reel cover pin hinge is aligned with pin hinge 10*c* and hinge pin 20*a* is inserted. This forms the pivot and attachment of cover 20 to reel bracket 10.

Operation-FIGS. 1 and 6

The manner of using the hose reel assembly is as follows:

To mount hose reel assembly on the side of the recreational vehicle, screw male connector 18 into the water inlet of the recreational vehicle. Slide r.v. mount bar 10-1 onto upper support arm 10*e* and align female connector 14-1 with male connector 18. Mark location of r.v. mount bar 10-1, in a level position above the water inlet, on the side of the recreational vehicle. Slide r.v. mount bar off support arm 10*e* and fasten secuely to the recreational vehicle with screws through the slots provided in the r.v. mount bar 10-1.

The parallel alignment between the body of the hose reel assembly and the recreational vehicle can be adjusted if required. Proper parallel alignment is necessary to ensure a connection between male connector 18 and female connector 14-1. Proper alignment will also ensure less drag on the hose reel and guide rollers 10*a* when unwinding or rewinding hose.

Slide reel mount bracket 10*e* into r.v. mount bar 10-1 until male connector 18 is aligned with female connector 14-1. Unfold lower support arm 10*g* to rest against the side of the recreational vehicle. Note the amount of adjustment required (either in or out) so that lower support arm 10*g* contacts the side of the recreational vehicle when connection is complete. Detach hose reel from r.v. mount bar 10-1 and make the adjustment of female connector 14-1 by turning the connector body clockwise (in) or counter clockwise (out) until the correct adjustment is obtained. Tighten adjustment lock nut 14*a* to secure the adjustment of female connector 14-1. Adjustments are required for the first installation only.

To use hose reel, slide reel assembly into r.v. mount bar 10-1 until proper alignment of connectors is obtained and push bottom of hose reel assembly toward recreational vehicle. When lower support arm 10*g* contacts the side of the recreational vehicle, connection is complete. Unreel potable water hose and connect to water main.

The method of use for the second embodiment is preferable if the hose reel assembly, when mounted on the recreational vehicle as in the first embodiment, will interfere with the water tank gravity filler or other devices or storage compartments.

Locate a suitable position for the hose reel assembly and ensure that adaptor hose 18*a* has enough length to connect to the water inlet. Attach r.v. mount bar 10-1 as described previously. Slide hose reel assembly into r.v. mount bar 10-1 and extend lower support arm 10*g*. No adjustment of female connector 14-1 is required.

Thread male connector 18 into recreational vehicle water inlet.

Thread male connector 18*e* and female connector 18*c* into adaptor hose 18*a*. Connect male connector 18*e* to female connector 14-1 and female connector 18*c* to male connector 18 (recreational vehicle). Unreel potable water hose and connect to water main.

To remove hose reel assembly, reverse the above procedure and store adaptor hose and related accessories in hose reel cover 20. Hose reel cover 20 also contains an external spigot 18*d*, which can be connected to female connector 14-2 and used as an auxiliary source of water outside the recreational vehicle.

SUMMARY, RAMIFICATIONS, AND SCOPE

From the descriptions above a number of advantages of my recreational vehicle hose reel become evident. Accordingly, the reader will see that this device can be easily installed and conveniently used and has further additional advantages.

Installation of the hose reel is faster and more convenient.

More reliable water connection points with less possibility of a leak developing.

Only the amount of hose needed to make the connection is used, leaving the balance neatly coiled on the reel.

Hose reel helps prevent hose from becoming twisted, kinked or otherwise damaged.

Hose rewinding is faster and cleaner.

Hose is automatically ready for storage when rewinding is complete.

Water hose is disconnected and hose reel is dismounted simultaneously by using the release bar mechanism.

All external hose reel support arms and handles fold flat against the body of the hose reel for convenient and economical storage.

The adaptor hose accessory allows the hose reel to be installed in a more convenient location if so desired or necessary.

The hose reel assembly can be removed from the recreational vehicle without releasing the water pressure from the main supply hose.

The adaptor hose can be used to refill the recreational vehicle water tank from the hose reel without having to disconnect main water supply line.

The design of the spigot shaft includes a second connection point and accessories can be used in conjunction with the hose reel without any disconnection of the main water supply line.

The use of the recreational vehicle hose reel eliminates the need for various hose saving devices such as elbows and flex protectors and other attachments including water diverters, water tank fillers and easy grippers for hose couplings.

Although the description above contains many specificities, these should not be construed as limiting the scope of the invention but as merely providing illustrations of some of the preferred embodiments of this invention. Thus the scope of this invention should be determined by the appended claims and their legal equivalents, rather than by the examples given.

I claim:

1. A portable hose storage reel with provision for an extra external water outlet port for recreational vehicles comprising:

(a) a spigot shaft with a plurality of water ports on fluted circumference and threaded apertures on each end (b) a spigot shaft including annular seals which are adjacent to a journaled surface on each end and a lock ring groove located at one end of tube (c) a flow through connector threadibly attached to each end of spigot shaft (d) a spigot shaft formed unitarily in the center of a rectangular mounting bracket suitably mortised and bored at each end as one half of a pin hinge (e) upper and lower support arms suitably mortised and bored to pivotally correspond to each end of mounting bracket (f) a release bar pivotally connected to the reverse side of the mounting bracket in a position directly in front of and covering flow through connector and extending downward below bottom of mounting bracket (g) a hub with interior journaled surfaces and annular seal grooves at each end corresponding to spigot shaft, formed unitarily with a fluid inlet tube and two discs of a larger diameter at each end of hub to form a reel of sufficient size (h) a hub with two slots in same alignment as retaining clip groove on spigot shaft and pivotally attached crank handle located on outside edge of reel.

* * * * *